US008907192B2

(12) United States Patent
Akiyama

(10) Patent No.: US 8,907,192 B2
(45) Date of Patent: Dec. 9, 2014

(54) WAVEFORM DATA GENERATING APPARATUS AND WAVEFORM DATA GENERATING PROGRAM

(71) Applicant: Yamaha Corporation, Hamanatsu (JP)

(72) Inventor: Hitoshi Akiyama, Hamamatsu (JP)

(73) Assignee: Yamaha Corporation (JP)

( * ) Notice: Subject to any disclaimer, the term of this patent is extended or adjusted under 35 U.S.C. 154(b) by 21 days.

(21) Appl. No.: 13/734,061

(22) Filed: Jan. 4, 2013

(65) Prior Publication Data

US 2013/0174716 A1 Jul. 11, 2013

(30) Foreign Application Priority Data

Jan. 6, 2012 (JP) ..... 2012-000910

(51) Int. Cl.
*G10H 7/00* (2006.01)

(52) U.S. Cl.
USPC ..... 84/604; 84/615; 84/653

(58) Field of Classification Search
USPC ..... 84/604, 615, 653
See application file for complete search history.

(56) References Cited

U.S. PATENT DOCUMENTS

| | | | | |
|---|---|---|---|---|
| 7,897,864 | B2 * | 3/2011 | Akiyama | 84/616 |
| 8,198,524 | B2 * | 6/2012 | Bastian et al. | 84/601 |
| 2005/0211068 | A1 | 9/2005 | Zar | |
| 2008/0243491 | A1 | 10/2008 | Matsuoka | |
| 2008/0250913 | A1 * | 10/2008 | Gerrits et al. | 84/604 |
| 2008/0260183 | A1 | 10/2008 | Hertzberg et al. | |
| 2011/0023691 | A1 * | 2/2011 | Iwase et al. | 84/612 |
| 2011/0150240 | A1 | 6/2011 | Akiyama et al. | |
| 2013/0174715 | A1 * | 7/2013 | Akiyama | 84/604 |
| 2013/0174716 | A1 * | 7/2013 | Akiyama | 84/604 |

FOREIGN PATENT DOCUMENTS

| | | | |
|---|---|---|---|
| EP | 2312763 | A1 | 4/2011 |
| JP | 2007-104598 | A | 4/2007 |
| WO | 2005055194 | A1 | 6/2005 |

OTHER PUBLICATIONS

European Search Report issued in European counterpart application No. EP12197636.9, dated Jul. 26, 2013.

* cited by examiner

*Primary Examiner* — David S. Warren
(74) *Attorney, Agent, or Firm* — Rossi, Kimms & McDowell LLP

(57) ABSTRACT

The waveform data generating apparatus has a waveform data generating circuit WP which inputs a digital signal formed of a plurality of bits which form a control signal for controlling an external apparatus, and generates waveform data indicative of a waveform of a control tone which corresponds to the input digital signal, is formed of tones corresponding to respective values of the bits of the input digital signal, and is formed of frequency components included in a certain high frequency band. The waveform data generating circuit WP has a basic waveform data extraction portion WP7 which extracts a part or a whole of the intermediate portion which is situated at an intermediate portion of the waveform data, and corresponds to the intermediate portion of the digital signal whose bit pattern coincides with a certain bit pattern as basic waveform data.

6 Claims, 10 Drawing Sheets

FIG.7

| | | | | | | | | | | | |
|---|---|---|---|---|---|---|---|---|---|---|---|
| 0 | 1 | 0 | 0 | 1 | 0 | 0 | 1 | 1 | 0 | 1 | P1 |
| 1 | 0 | 1 | 1 | 0 | 1 | 1 | 0 | 0 | 1 | 0 | N1 |
| 1 | 1 | 1 | 0 | 0 | 0 | 1 | 1 | 0 | 0 | 0 | P0 |
| 0 | 0 | 0 | 1 | 1 | 1 | 0 | 0 | 1 | 1 | 1 | N0 |

FIG.9

| basic waveform data | differential code |
|---|---|
| g1 | latter half of P0→first half of N1 |
| g2 | latter half of P0→first half of N0 |
| g3 | latter half of N0→first half of P1 |
| g4 | latter half of N0→first half of P0 |
| g5 | latter half of P1→first half of P1 |
| g6 | latter half of P1→first half of P0 |
| g7 | latter half of N1→first half of N1 |
| g8 | latter half of N1→first half of N0 |

FIG.10

| basic waveform data | differential code |
|---|---|
| f1 | P0 |
| f2 | N0 |
| f3 | P1 |
| f4 | N1 |

FIG.11

| basic waveform data | symbol on MSB side | symbol for which basic waveform data is extracted | symbol on LSB side |
|---|---|---|---|
| h1 | 0 | 0 | 0 |
| h2 | 0 | 0 | 1 |
| h3 | 1 | 0 | 0 |
| h4 | 1 | 0 | 1 |
| h5 | 0 | 1 | 0 |
| h6 | 0 | 1 | 1 |
| h7 | 1 | 1 | 0 |
| h8 | 1 | 1 | 1 |

WAVEFORM DATA GENERATING APPARATUS AND WAVEFORM DATA GENERATING PROGRAM

BACKGROUND OF THE INVENTION

1. Field of the Invention

The present invention relates to a waveform data generating apparatus for generating waveform data indicative of waveforms of tones which are to be stored in a storage device provided in a musical performance apparatus such as an electronic organ and an electronic piano, and a computer program applied to the waveform data generating apparatus.

2. Description of the Related Art

Conventionally, as described in Japanese Unexamined Patent Publication No. 2007-104598, for example, there is a known information transmitting apparatus which emits control tones for controlling an external apparatus. The information transmitting apparatus has a modulator which generates control tones by modulating carrier waves of audible frequencies by use of control information.

SUMMARY OF THE INVENTION

However, the modulator of the conventional information transmitting apparatus is expensive, because the modulator is formed of a plurality of information processors in order to perform complicated computations. Therefore, there is a problem that a musical performance apparatus such as an electronic organ and an electronic piano in which the modulator is employed is expensive. Therefore, it can be considered that it is preferable to previously store waveform data indicative of waveforms of control tones in a storage device so that the waveform data can be read out at the timing at which control information is transmitted to reproduce a control tone. However, there is a problem that in a case where there are many kinds of control information, the storage device has to have a large storage capacity in order to store sets of waveform data indicative of control tones corresponding to the pieces of control information.

The present invention was accomplished to solve the above-described problem, and an object thereof is to provide a waveform data generating apparatus for generating waveform data sets indicative of waveforms representative of parts commonly used in control tones corresponding to different kinds of control information. As for descriptions for respective constituents of the present invention described below, numbers corresponding to components of a later-described embodiment are given in parenthesis for easy understanding. However, the respective constituents of the present invention are not limited to the corresponding components indicated by the numbers of the embodiment.

In order to achieve the above-described object, it is a feature of the present invention to provide a waveform data generating apparatus including waveform data generating portion (WP1 to WP6) inputting a digital signal formed of a plurality of bits which form a control signal (SD) for controlling an external apparatus, and generating waveform data indicative of a waveform of a control tone which corresponds to the input digital signal, is formed of tones corresponding to respective values of the bits of the input digital signal, and is formed of frequency components included in a certain high frequency band; basic waveform data extracting portion (WP7) extracting a part or a whole of a intermediate portion which is situated at an intermediate portion of the waveform data, and corresponds to the intermediate portion of the digital signal whose bit pattern coincides with a certain bit pattern as basic waveform data (f1 to f4,g1 to g8,h1 to h8); and storing portion (13*c*,13*d*,14) storing the extracted basic waveform data. In this case, the control tone is a modulated tone obtained by modulating a carrier wave by use of the digital signal.

In this case, furthermore, the external apparatus may have a display unit (22) to display a score, the digital signal has a score page designating signal which designate the page position of the score to be displayed on the display unit.

In this case, furthermore, the score page designating signal may be generated by spreading the data representative of the page position of the score to be displayed on the display unit and modulating the spread data by using differential phase shift modulation scheme.

By generating the basic waveform data on the waveform data generating apparatus configured as above, a musical performance apparatus can reproduce tones corresponding to a control signal which is to be transmitted to an external apparatus by appropriately combining one or more basic waveform data sets in accordance with a bit pattern of the control signal. Therefore, compared to a case where waveform data sets each indicative of an entire control tone are stored in a musical performance apparatus, this configuration can save storage capacity of a storage device. Furthermore, because tones corresponding to the control signal are formed of frequency components included in the certain high frequency band, a performer rarely recognizes generated tones corresponding to the control signal. Therefore, the performer's musical performance will not be hindered.

The other feature of the present invention is that the basic waveform data extracting portion extracts the intermediate portion which is situated at a intermediate portion of the waveform data and includes a portion equivalent to a boundary of two neighboring bits of the certain bit pattern as the basic waveform data. The other feature prevents interruption of tones that can occur at boundaries of bits which form the control signal on the musical performance apparatus which generates tones by use of the basic waveform data. Furthermore, depending on a coding scheme or a modulation scheme employed in order to generate waveform data, a tone equivalent to the top of a bit of the control signal can be affected by a tone equivalent to the end of an adjacent bit (e.g., due to group delay of filter). In a case where tones are combined simply in accordance with bit values of the control signal without consideration given to the above-described influence, therefore, noises ranging over a wide frequency band can generate at boundaries of tones corresponding to the bits. By the configuration described above, however, the noises can be avoided. Resultantly, the other feature of the present invention enhances accuracy of decoding of control signal by an external apparatus.

The present invention can be embodied not only as the waveform data generating apparatus but also as a computer program applied to the apparatus.

BRIEF DESCRIPTION OF THE DRAWINGS

FIG. 7 is a diagram indicative of example differential codes;

FIG. 9 is a diagram indicative of respective configurations of control waveform data sets;

FIG. 10 is a table indicative of an example correspondence between basic waveform data and differential codes;

FIG. 11 is a table indicative of a different example correspondence between basic waveform data and differential codes.

DESCRIPTION OF THE PREFERRED EMBODIMENT

Figure 1:
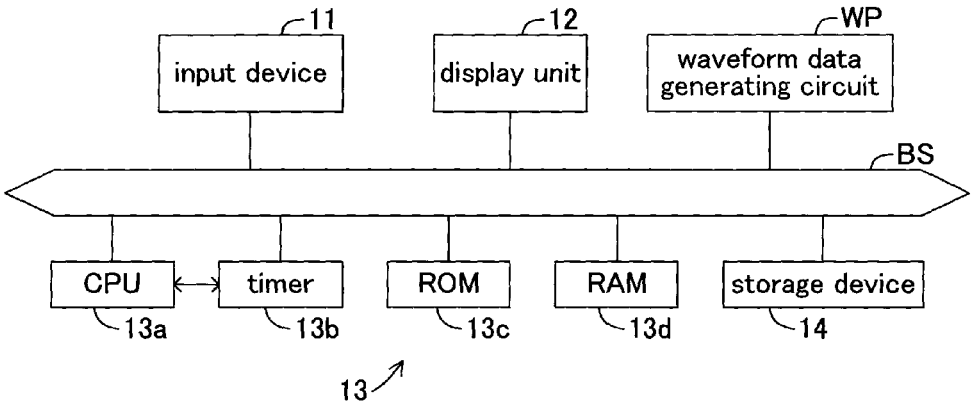
FIG. 1 is a block diagram indicative of an entire configuration of a waveform data generating apparatus.

A configuration of a waveform data generating apparatus according to an embodiment of the present invention will be explained with reference to FIG. 1. The waveform data generating apparatus generates basic waveform data which is data of basic waveforms that form waveforms of control tones corresponding to various kinds of musical score data which controls a musical score display apparatus which has display unit for displaying musical score. The basic waveform data is stored in a storage device of a musical performance apparatus. By using sets of basic waveform data in combination, the musical performance apparatus emits a control tone corresponding to musical score data that the musical performance apparatus transmits, and controls the musical score display apparatus. The waveform data generating apparatus has an input device 11, a display unit 12, a computer portion 13, a storage device 14 and a waveform data generating circuit WP.

The input device 11 has a keyboard, a mouse and the like, so that operating information indicative of user's operation on the input device 11 will be supplied to the computer portion 13 via a bus BS. The display unit 12 is configured by a liquid crystal display (LCD), and displays letters, graphics (e.g., waveform of control tone) and the like on a screen. The display of the display unit 12 is controlled by the computer portion 13 via the bus BS.

The computer portion 13 is formed of the CPU 13*a*, a timer 13*b*, a ROM 13*c* and a RAM 13*d* which are connected to the bus BS. The CPU 13*a* executes a waveform data generating program which is not shown by use of the timer 13*b*, the ROM 13*c* and the RAM 13*d*. In accordance with operating information, as a result, the CPU 13*a* supplies musical score data to the waveform data generating circuit WP which will be described in detail later to allow the waveform data generating circuit WP to generate basic waveform data and writes the generated basic waveform data in the storage device 14.

The storage device 14 includes large-capacity nonvolatile storage media such as HDD, FDD, CD-ROM, MO and DVD, and drive units for the storage media to enable storage and reading of various kinds of data and programs.

Figure 2:
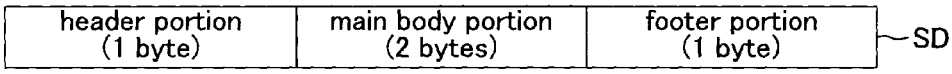
FIG. 2 is a diagram indicative of a configuration of musical score data.

Next, the waveform data generating circuit WP will be explained in detail. In this explanation, musical score data SD is formed of a header portion, a main body portion and a footer portion as indicated in FIG. 2. The header portion is data of 1 byte which includes information representative of the length of the main body portion. The main body portion is data of 2 bytes including musical piece information representative of a musical piece number and page information representative of page position of a musical score. The footer portion is data of 1 byte including information representative of the end of the musical score data SD. Hereafter, the musical score data SD will be explained as data having 32 bits as a whole. More specifically, the 0th bit of the footer portion is referred to as the least significant bit LSB of the musical score data SD, while the 7th bit of the header portion is referred to as the most significant bit MSB of the musical score data SD. The most significant bit MSB and the least significant bit LSB are dummy data, and will be ignored by the musical score display apparatus.

Figure 3:
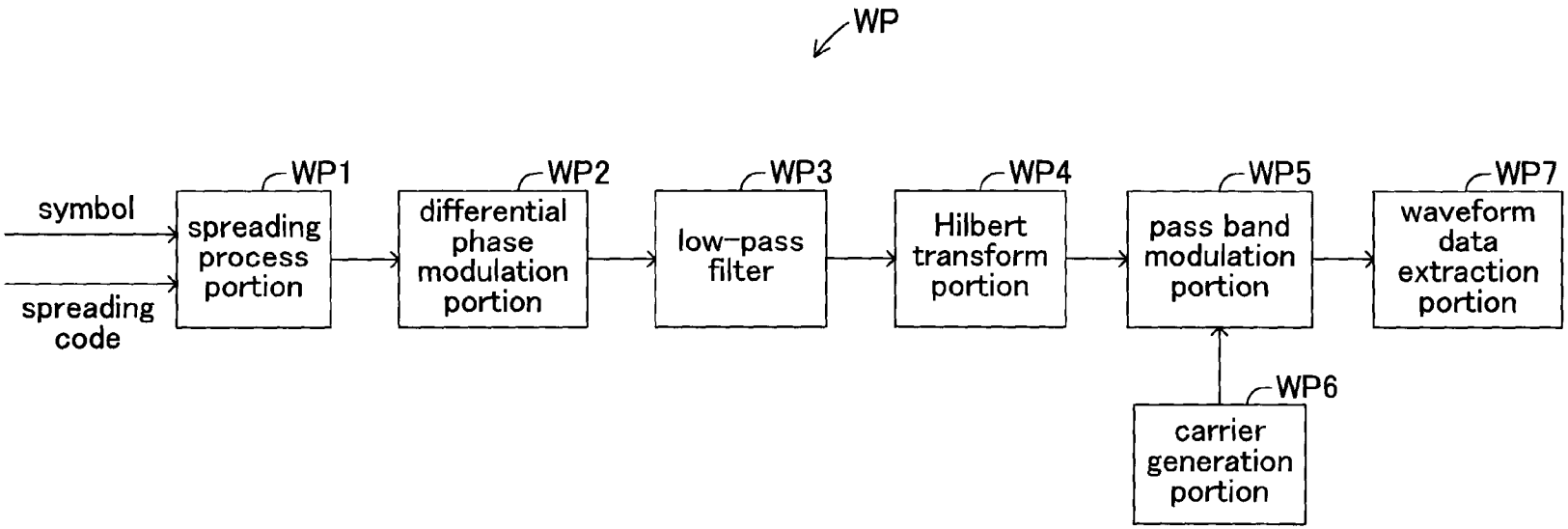
FIG. 3 is a block diagram indicative of an entire configuration of a waveform data generating circuit.

As indicated in FIG. 3, the waveform data generating circuit WP is formed of a spreading process portion WP1, a differential phase modulation portion WP2, a low-pass filter WP3, a Hilbert transform portion WP4, a pass band modulation portion WP5, a carrier generation portion WP6 and a waveform data extraction portion WP7.

Figure 4:
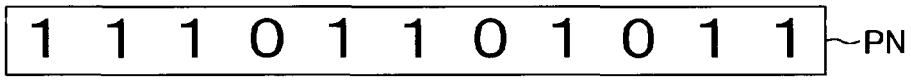
FIG. 4 is a diagram indicative of an example spreading code.

The musical score data SD supplied from the CPU 13*a* is orderly input one bit by one bit into the spreading process portion WP1, starting with the least significant bit LSB toward the most significant bit MSB. Hereafter, each bit of the musical score data SD will be referred to as a symbol. To the spreading process portion WP1, furthermore, a spreading code PN will be also input. The spreading code PN is a pseudorandom number code string having a certain periodicity. In this embodiment, the spreading code PN is a code of 11 chips as indicated in FIG. 4. Each bit of the spreading code PN is referred to as a chip. A symbol rate "fa" which is a communication speed at which the musical score data SD is transmitted in a base band is 400.9 sps (symbol/second) (see FIG. 5). The periodicity of the spreading code PN coincides with the symbol rate "fa". Therefore, a chip rate "fb" of the spreading code PN is 4,410 cps (chip/second).

Figure 5:
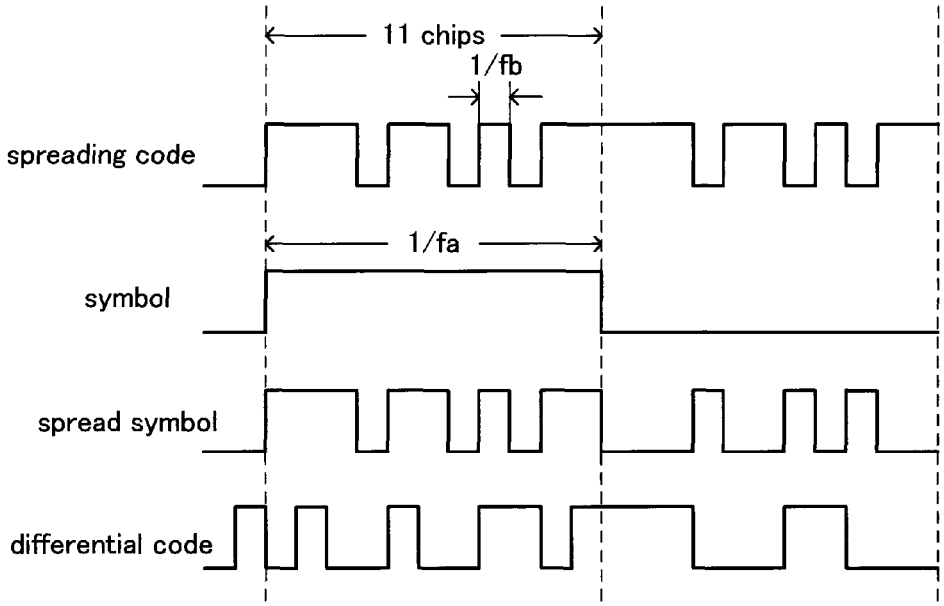
FIG. 5 is a timing chart indicative of operation of a spreading process portion and a differential phase modulation portion indicated in FIG. 3.

The symbols input to the spreading process portion WP1 are spread by use of the spreading code PN. As indicated in FIG. 5, more specifically, in a case where a value of a symbol is "1", the spreading code PN is directly output from the spreading process portion WP1. In a case where a value of a symbol is "0", a code obtained by reversing the phase of the spreading code PN is output from the spreading process portion WP1.

Figure 6:
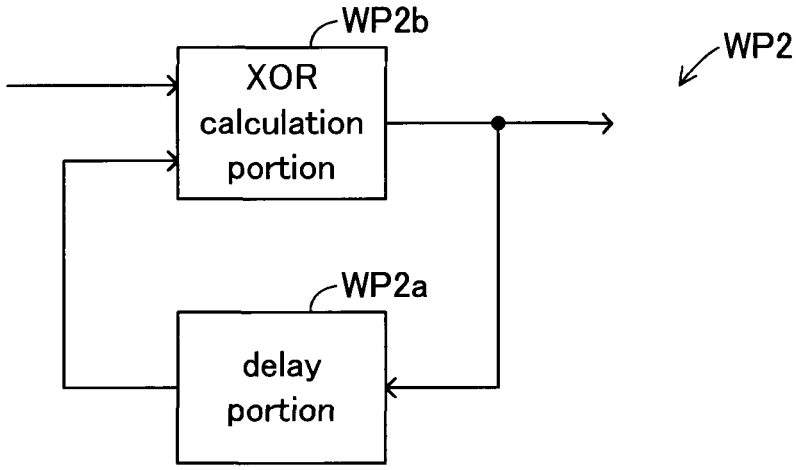
FIG. 6 is a block diagram indicative of a configuration of the differential phase modulation portion indicated in FIG. 3.

The symbols spread by the spreading process portion WP1 are input to a differential phase modulation portion WP2 one chip by one chip, starting with the top chip toward the last chip. As indicated in FIG. 6, the differential phase modulation portion WP2 is formed of a delay portion WP2*a* and an XOR calculation portion WP2*b*. The delay portion WP2*a* delays a calculated result output from the XOR calculation portion WP2*b* which will be explained next by a period of 1 chip, and then outputs the delayed result to the XOR calculation portion WP2*b*. The XOR calculation portion WP2*b* performs the exclusive-OR operation between a value of a code input from the delay portion WP2*a* and a value of a code input from the spreading process portion WP1, and then outputs the calculated result. Each symbol spread by the spreading process portion WP1 is converted into any one of four codes by the differential phase modulation portion WP2 as indicated in FIG. 7. More specifically, a symbol whose value is "1" is converted into differential code P1 or differential code N1, while a symbol whose value is "0" is converted into differential code P0 or differential code N0.

The differential code output from the XOR calculation portion WP2*b* is input to the low-pass filter WP3. The low-pass filter WP3 is a filter for restricting frequency band of control tone output from the later-described pass band modulation portion WP5. The differential code output from the low-pass filter WP3 is input to the Hilbert transform portion WP4. The Hilbert transform portion WP4 transforms the differential code by shifting the phase of the differential code. The pass band modulation portion WP5 modulates a carrier output from the carrier generation portion WP6 by use of a signal output from the Hilbert transform portion WP4, and shifts the frequency band of the differential code to a high frequency band included in an audio band, also extracting the upper sideband and outputting a control tone formed of frequency components included in the upper sideband. By reducing the frequency band of the differential code by half as described above, the embodiment reduces influence caused by noise to enhance accuracy of decoding of the musical score data SD by the musical score display apparatus. Because the frequency of the carrier is 17.64 kHz, the control tone is hard to be heard in general. Then, the waveform data extraction portion WP7 samples the control tone, and stores sample values of sampling periods as waveform data of the control tone in a buffer memory. The sampling frequency is 44.1 kHz.

Although the differential codes P1, P0, N1, and N0 are sequentially output from the differential phase modulation portion WP2, the manner in which the type of differential codes transitions is limited to the 8 different transitions (see FIG. 9). Therefore, digital signals (e.g., one or more sets of musical score data) are input to the spreading process portion WP1 of the control waveform data generation apparatus WP so that indicative of the above-described 8 different transitions are output from the differential phase modulation portion WP2 to store waveform data indicative of control tone in a buffer memory. Then, the waveform data extraction portion WP7 extracts certain sample values from among the waveform data indicative of the control tone stored in the buffer memory as basic waveform data g1 to g8. With a part at which differential codes switch being assumed as a center, more specifically, a plurality of sample values situated in front of and behind the centers are extracted. In this embodiment, the sampling frequency is 44.1 kHz. In a case where 110 sample values are extracted with parts at which differential codes switch being assumed as centers, as described above, the top of each set of basic waveform data g1 to g8 is equivalent to the center of a differential code of the first half, while the end of each set of basic waveform data g1 to g8 is equivalent to the center of a differential code of the latter half.

Figure 8:
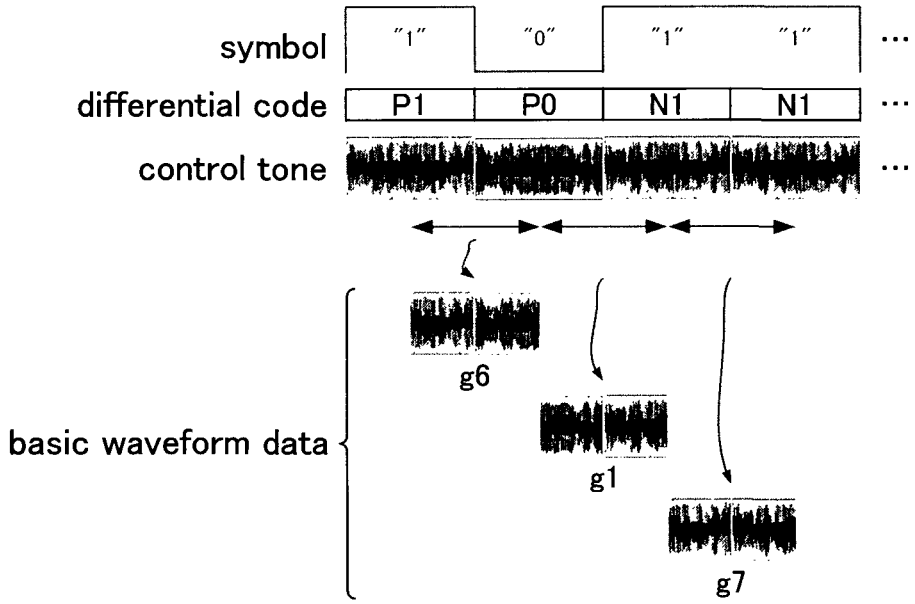
FIG. 8 is a diagram explaining retrieval of basic waveform data.

As indicated in FIG. 8 and FIG. 9, a part equivalent to the latter half of the differential code P0 and the first half of the differential code N1 is extracted as basic waveform data g1. The other sets of basic waveform data g2 to g8 are also extracted similarly to the basic waveform data g1. More specifically, a part equivalent to the latter half of the differential code P0 and the first half of the differential code N0 is extracted as basic waveform data g2. Furthermore, a part equivalent to the latter half of the differential code N0 and the first half of the differential code P1 is extracted as basic waveform data g3, while a part equivalent to the latter half of the differential code N0 and the first half of the differential code P0 is extracted as basic waveform data g4. Furthermore, a part equivalent to the latter half of the differential code P1 and the first half of the differential code P1 is extracted as basic waveform data g5, while a part equivalent to the latter half of the differential code P1 and the first half of the differential code P0 is extracted as basic waveform data g6. Furthermore, a part equivalent to the latter half of the differential code N1 and the first half of the differential code N1 is extracted as basic waveform data g7, while a part equivalent to the latter half of the differential code N1 and the first half of the differential code N0 is extracted as basic waveform data g8. The waveform data extraction portion WP7 supplies the basic waveform data g1 to g8 extracted as described above to the CPU 13*a*. The CPU 13*a* stores the basic waveform data g1 to g8 in the storage device 14 (or in the ROM 13*c*, RAM 13*d* or the like). Sample values which form each of the control waveform data sets are stored in successive addresses in the order in which the sample values are sampled for each control waveform data set. The basic waveform data sets g1 to g8 have the same data size. The basic waveform data g1 to g8 stored in the storage device 14 is written into a flash ROM, a mask ROM or the like to be contained in the musical performance apparatus.

The musical performance apparatus can form waveform data indicative of the whole of a desired control tone by appropriately combining the basic waveform data sets g1 to g8. For selecting basic waveform data corresponding to one symbol which forms musical score data SD, however, consideration must be given to the kind of a differential code corresponding to a symbol situated immediately in front of the symbol (on the least significant bit LSB side). More specifically, a set of basic waveform data is selected to agree with the transition of differential codes ranging from the least significant bit LSB to the most significant bit MSB of the musical score data SD. Such extraction of the basic waveform data sets g1 to g8 can save storage capacity of the musical performance apparatus, compared to a case where waveform data sets each indicative of an entire control tone are stored for respective musical score data sets SD having different values in a storage device of the musical performance apparatus.

In the case of the above-described configuration, furthermore, parts equivalent to boundaries of the symbols of the control tones can be affected by the processing by the low-pass filter WP3 and the Hilbert transform portion WP4. Therefore, this embodiment is designed such that the basic waveform data sets g1 to g8 are extracted with the boundaries of the symbols (differential codes) being defined as mid-points. As a result, when the musical performance apparatus generates tones corresponding to control signals by use of the basic waveform data, this embodiment prevents the parts equivalent to the boundaries of the symbols from noise ranging across a wide frequency band, eliminating the possibility of interfered musical performance. Therefore, this embodiment is able to increase accuracy of decoding control signals by the musical score display apparatus.

In carrying out the invention, the invention is not limited to the above-described embodiment, but can be variously modified without departing from the object of the present invention.

The modulation scheme (control tone generating scheme) performed by the control waveform data generating apparatus WP is not limited to that I of the above-described embodiment and its modifications, but can be any schemes.

In the above-described embodiment and its modifications, the differential phase modulation portion WP2 performs the differential binary phase shift keying (DBPSK) which is the scheme to output the differential codes in accordance with the sequence of the values of the chips output from the spreading process portion WP1. The embodiment can be modified such that the differential phase modulation portion WP2 selects neighboring chips two by two which form the signal output from the spreading process portion WP1 stating with top chip toward the last chip, and determine the value of the next chip in accordance with the values of the selected chips. In other words, the differential phase modulation portion WP2 may perform the differential quadrature phase shift keying (DQPSK).

Furthermore, the spreading process can be canceled. In this case, a symbol which will be transmitted may be directly converted into differential codes without being spread.

Furthermore, the conversion into differential codes can be canceled. In this case, the carrier wave may be modulated in accordance with the values of the chips which are output from the spreading process portion WP1.

Furthermore, the spreading process and the conversion into differential codes can be canceled. In this case, the waveform data generating apparatus WP may be vary amplitude or phase of the carrier wave in accordance with symbol value. In case that the conversion into differential code is canceled, synchronization signals representative of the timing for detecting the control tone may be separately transmitted from the musical performance apparatus 1 to the musical score display apparatus 20.

Furthermore, the Hilbert transform potion WP4 of the waveform data generating apparatus WP transforms the differential codes so that the upper sideband of the frequency band of the differential code can be extracted. By reducing the frequency band of the differential code as described above, the embodiment reduces influence caused by noise. In case the control tone has a sufficiently wide bandwidth or noise has very low amplitude, the Hilbert transform processing can be canceled and the control tone may be formed of frequency components included in the both sideband.

Furthermore, the modulation scheme performed by the pass band modulation portion WP5 is not limited to that of the above-described embodiment and its modifications, but can be any schemes. For instance, the amplitude shift keying or the frequency shift keying can be employed. In this case, the pass band modulation portion WP5 may modulate the carrier wave in accordance with the value of each bit which forms the signal which is input into the pass band modulation portion WP5, or may modulate carrier wave in accordance with the values of a plurality of bits which form the signal. For instance, the On/Off modulation scheme which is a sort of the amplitude shift keying is employed. In this case, the pass band modulation portion WP5 switches on/off the carrier wave in accordance with the value of signal which is input into the pass band modulation portion WP5 and may output a signal like Morse signal.

In case the modulation scheme which is different from that of above-described embodiment or its modifications is employed, the score display apparatus 20 may perform the decode processing by the scheme corresponding to the modulation scheme which is employed in the musical performance apparatus 10.

Furthermore, for instance, the waveform data extraction portion WP7 may extract basic waveform data sets to correspond to differential code types. More specifically, the waveform data extraction portion WP7 may extract the basic waveform data sets so that each basic waveform data will not straddle a boundary between differential codes. As indicated in FIG. 10, more specifically, a part included in an input control tone and corresponding to the differential code P0 is extracted as basic waveform data f1, while a part corresponding to the differential code N0 is extracted as basic waveform data f2. Furthermore, a part corresponding to the differential code P1 is extracted as basic waveform data f3, while a part corresponding to the differential code N1 is extracted as basic waveform data f4.

The basic waveform data sets f1 to f4 extracted as described above are to be stored in the storage device of the musical performance apparatus. Then, the musical performance apparatus is to convert symbols of musical score data SD which will be transmitted into differential codes, to select basic waveform data sets to correspond to the sequence of the differential codes, and to reproduce the selected basic waveform data sets. This configuration can also save storage capacity of the musical performance apparatus, compared to the case where waveform data sets each indicative of an entire control tone are stored for respective musical score data sets SD having different values in the storage device of the musical performance apparatus.

Similarly to the above-described embodiment and its modifications, however, in a case which employs a modulation scheme by which a tone corresponding to a symbol (or a differential code) affects the top of a tone corresponding to the next symbol, sets of basic waveform data are extracted as different types of basic waveform data depending on values of neighboring symbols situated on the most significant bit MSB side and the least significant bit LSB side of a target symbol for which corresponding waveform data will be extracted.

Figure 12:
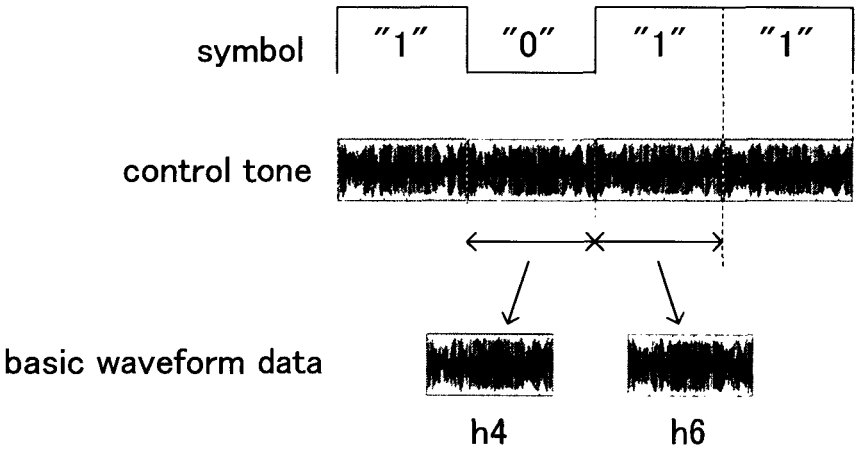
FIG. 12 is a diagram explaining retrieval of the basic waveform data indicated in FIG. 11.

As indicated in FIG. 11 and FIG. 12, more specifically, assuming that a symbol having a value "0" is a target symbol, if values of symbols adjacent to the symbol on the most significant bit MSB side and the least significant bit LSB side (hereafter simply referred to as adjacent symbols) are "0" and "0", respectively, a waveform corresponding to the target symbol is extracted as basic waveform data h1. If values of adjacent symbols are "0" and "1", the waveform corresponding to the target symbol is extracted as basic waveform data h2. If values of adjacent symbols are "1" and "0", the waveform corresponding to the target symbol is extracted as basic waveform data h3. If values of adjacent symbols are "1" and "1", the waveform corresponding to the target symbol is extracted as basic waveform data h4.

The extraction of basic waveform data h5 to h8 corresponding to a symbol having a value "1" is done similarly to the case of the symbol having the value "0". More specifically, if the values of adjacent symbols are "0" and "0", a waveform corresponding to the target symbol is extracted as basic waveform data h5. If the values of adjacent symbols are "0" and "1", the waveform corresponding to the target symbol is extracted as basic waveform data h6. If the values of adjacent symbols are "1" and "0", the waveform corresponding to the target symbol is extracted as basic waveform data h7. If the values of adjacent symbols are "1" and "1", the waveform corresponding to the target symbol is extracted as basic waveform data h8. FIG. 12 indicates an example of a case where the basic waveform data h4 and the basic waveform data h6 are extracted.

The basic waveform data sets h1 to h8 extracted as described above are to be stored in the storage device of the musical performance apparatus, while the musical performance apparatus is to select and reproduce sets of basic waveform data so that the selected sets of basic waveform data will correspond to the bit pattern of musical score data SD which will be transmitted. For selecting basic waveform data corresponding to one symbol which forms musical score data SD, however, consideration must be given to values of symbols adjacent to the symbol. For selecting basic waveform data corresponding to a symbol having a value "0", for example, a set of basic waveform data is to be selected from among the basic waveform data sets h1 to h4 in accordance with the values of symbols adjacent to the symbol. Furthermore, for selecting basic waveform data corresponding to a symbol having a value "1", a set of basic waveform data is to be selected from among the basic waveform data sets h5 to h8 in accordance with the values of symbols adjacent to the symbol. In a case where a set of basic waveform data corresponding to the least significant symbol is to be selected, consideration is given only to a value of a neighboring symbol situated on the most significant bit MSB side. In a case where a set of basic waveform data corresponding to the most significant symbol is to be selected, consideration is given only to a value of a neighboring symbol situated on the least significant bit LSB side.

In a case where a value of the 0th bit (the least significant bit LSB) of the musical score data SD is "0", the basic waveform data h1 or h3 will be selected in accordance with a value of the 1st bit. In a case where a value of the 0th bit of the musical score data SD is "1", the basic waveform data h5 or h7 will be selected in accordance with a value of the 1st bit. In a case where a value of the 31st bit (the most significant bit MSB) of the musical score data SD is "0", the basic waveform data h1 or h2 will be selected in accordance with a value of the 30th bit. In a case where a value of the 31st bit of the musical score data SD is "1", the basic waveform data h5 or h6 will be selected in accordance with a value of the 30th bit.

By the above-described configuration as well, the musical performance apparatus can form waveform data indicative of the whole of a desired control tone by appropriately combining sets of basic waveform data h1 to h8. Therefore, this configuration can also save storage capacity of the musical performance apparatus, compared to the case where waveform data sets each indicative of an entire control tone are stored for respective musical score data sets SD having different values in the storage device of the musical performance apparatus.

Without using the waveform data generating circuit WP, furthermore, the waveform data may be generated by the computer portion 13. More specifically, processing such as conversion of symbols into differential codes, and generation and modulation of carrier waves may be done by numerical calculations by software.

The format of the musical score data SD is not limited to that of the above-described embodiment and its modifications, but can be any format. Furthermore, waveform data which will be generated is not limited to waveform data corresponding to musical score data SD but can be any waveform data as long as the waveform data corresponds to control data for controlling an external apparatus.

What is claimed is:

1. A waveform data generating apparatus comprising:

a waveform data generating portion configured to receive a digital signal formed of a plurality of bits which form a control signal for controlling an external apparatus, and configured to generate waveform data indicative of a waveform of a control tone which corresponds to the input digital signal, the control tone being formed of tones corresponding to respective values of the bits of the input digital signal, and being formed of frequency components included in a high frequency band;

a basic waveform data extracting portion configured to extract a part or a whole of an intermediate portion as basic waveform data, the intermediate portion being situated at an intermediate portion of the waveform data and corresponding to the intermediate portion of the digital signal whose bit pattern coincides with a certain bit pattern; and a storing portion configured to store the extracted basic waveform data.

2. The waveform data generating apparatus according to claim 1, wherein the basic waveform data extracting portion extracts the intermediate portion which is situated at an intermediate portion of the waveform data and includes a portion equivalent to a boundary of two neighboring bits of the certain bit pattern as the basic waveform data.

3. The waveform data generating apparatus according to claim 1, wherein the control tone is a modulated tone obtained by modulating a carrier wave by use of the digital signal.

4. The waveform data generating apparatus according to claim 1, wherein the external apparatus has a display unit to display a score; and the digital signal has a score page designating signal which designates the page position of the score to be displayed on the display unit.

5. The waveform data generating apparatus according to claim 4, wherein the score page designating signal is generated by spreading the data representative of the page position of the score to be displayed on the display unit and modulating the spread data by using a differential phase shift modulation scheme.

6. A non-transitory computer-readable storage medium storing a program applied to a waveform data generating apparatus for generating waveform data indicative of a waveform of a tone, the program causing, when executed by a computer, the computer to perform the functions of:

a waveform data generating function of inputting a digital signal formed of a plurality of bits which form a control signal for controlling an external apparatus, and generating waveform data indicative of a waveform of a control tone which corresponds to the input digital signal, the control tone being formed of tones corresponding to respective values of the bits of the input digital signal, and being formed of frequency components included in a high frequency band;

a basic waveform data extracting function of extracting a part or a whole of an intermediate portion as basic waveform data, the intermediate portion being situated at an intermediate portion of the waveform data and corresponding to the intermediate portion of the digital signal whose bit pattern coincides with a certain bit pattern; and a storing function of storing the extracted basic waveform data.

* * * * *